US005336536A

United States Patent [19]

Oberzan

[11] Patent Number: 5,336,536

[45] Date of Patent: Aug. 9, 1994

[54] COLLAPSIBLE CONE STRUCTURE

[76] Inventor: August J. Oberzan, 8000 W. 113th St., Overland Park, Kans. 66210

[21] Appl. No.: 40,831

[22] Filed: Mar. 31, 1993

[51] Int. Cl.[5] ..... A47G 33/06

[52] U.S. Cl. ..... 428/8; 428/9; 428/18; 428/20; 428/37; 211/196

[58] Field of Search ..... 428/37, 8, 9, 18, 20, 428/12; 211/196, 205

[56] References Cited

U.S. PATENT DOCUMENTS

| | | | |
|---|---|---|---|
| 2,731,752 | 1/1956 | Erickson et al. | 428/18 |
| 2,841,901 | 7/1958 | Maple | 428/18 |
| 3,176,123 | 3/1965 | Blake | 428/18 |
| 3,677,867 | 7/1982 | Westlund | 428/18 |
| 4,620,270 | 10/1986 | Laakso | 428/18 |

FOREIGN PATENT DOCUMENTS

| | | | |
|---|---|---|---|
| 168799 | 7/1959 | Sweden | 428/18 |

*Primary Examiner*—Alexander S. Thomas

*Attorney, Agent, or Firm*—Litman, McMahon & Brown

[57] ABSTRACT

A collapsible cone structure includes a base, an upright support and a spiral coil. The coil is shiftable between a supported, cone-shaped extended configuration and a flattened configuration which may be easily stored or transported. Preferably the structure includes a detachable theme head including a support, a plurality of coil segments and a vertically adjustable coupling pin. Other preferred forms include detachable wings.

In particularly preferred forms, the cone structure includes a base, a spiral coil, and a fastener. The coil is shiftable between a cone-shaped resting configuration and a flattened extended configuration which may be latched in place.

7 Claims, 3 Drawing Sheets 10
40
44
62
14
36
16
46
42
38
48
12
18
6.
7.
64
130
132
134
136
140
142
26
66

COLLAPSIBLE CONE STRUCTURE

BACKGROUND OF THE INVENTION

1. Field of the Invention

The present invention is broadly concerned with a collapsible cone structure that is stable, lightweight, easy to erect, and resistant to wind, snow and ice. More particularly, it is concerned with a cone structure having a lightweight but stable base, a support frame, and a continuous coil body. The body of the structure is collapsible on the base to a flattened configuration.

2. Description of the Related Art

A number of cone structures have been proposed in the past for use as artificial Christmas trees. In general, these devices are not suitable for outdoor use. Typically they are not free-standing and must be hung from a ceiling or frame. Models which are capable of standing alone tend to be heavy, and are not collapsible to a flattened, easily transportable unit. Such units have not been designed for decorative use throughout the year, but rather are limited in use to the Christmas season. Moreover, the construction of such units has limited them to decorative use and, because they are bulky and difficult to assemble, they have not been suitable for use as transportation markers and signage.

SUMMARY OF THE INVENTION

The present invention overcomes the problems previously outlined and provides a greatly improved collapsible cone structure. Broadly speaking, the structure includes a base, an upright support and a spiral coil. The coil is shiftable between a supported, cone-shaped extended configuration and a flattened configuration which may be easily stored or transported. Preferably the structure includes a detachable theme head including a support, a plurality of coil segments and a vertically adjustable coupling pin. Other preferred forms include detachable wings.

In particularly preferred forms, the cone structure includes a base, a spiral coil, and a fastener. The coil is shiftable between a cone-shaped resting configuration and a flattened configuration which may be latched in place to prevent the coil from returning to the core configuration.

OBJECTS AND ADVANTAGES OF THE INVENTION

The principal objects and advantages of the present invention include: providing a collapsible cone structure that is lightweight, and presents a minimum shipping weight; providing such a structure that is not bulky, is easy to load and transport, and requires minimal storage space; providing such a structure that is easy to erect by one person without tools; providing such a structure which can be provided with a wide variety of coverings and ornamentations; providing such a structure that is suitable for indoor and outdoor use and is resistant to wind, snow and ice; providing such a structure that is visible from a distance and provides good light refraction; providing such a structure that is weather resistant, long lived, and requires minimal maintenance; providing such a structure that is resilient, and does not easily cause or incur damage upon impact; and providing such a structure that is of economical construction.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figures 1, 2, 3:
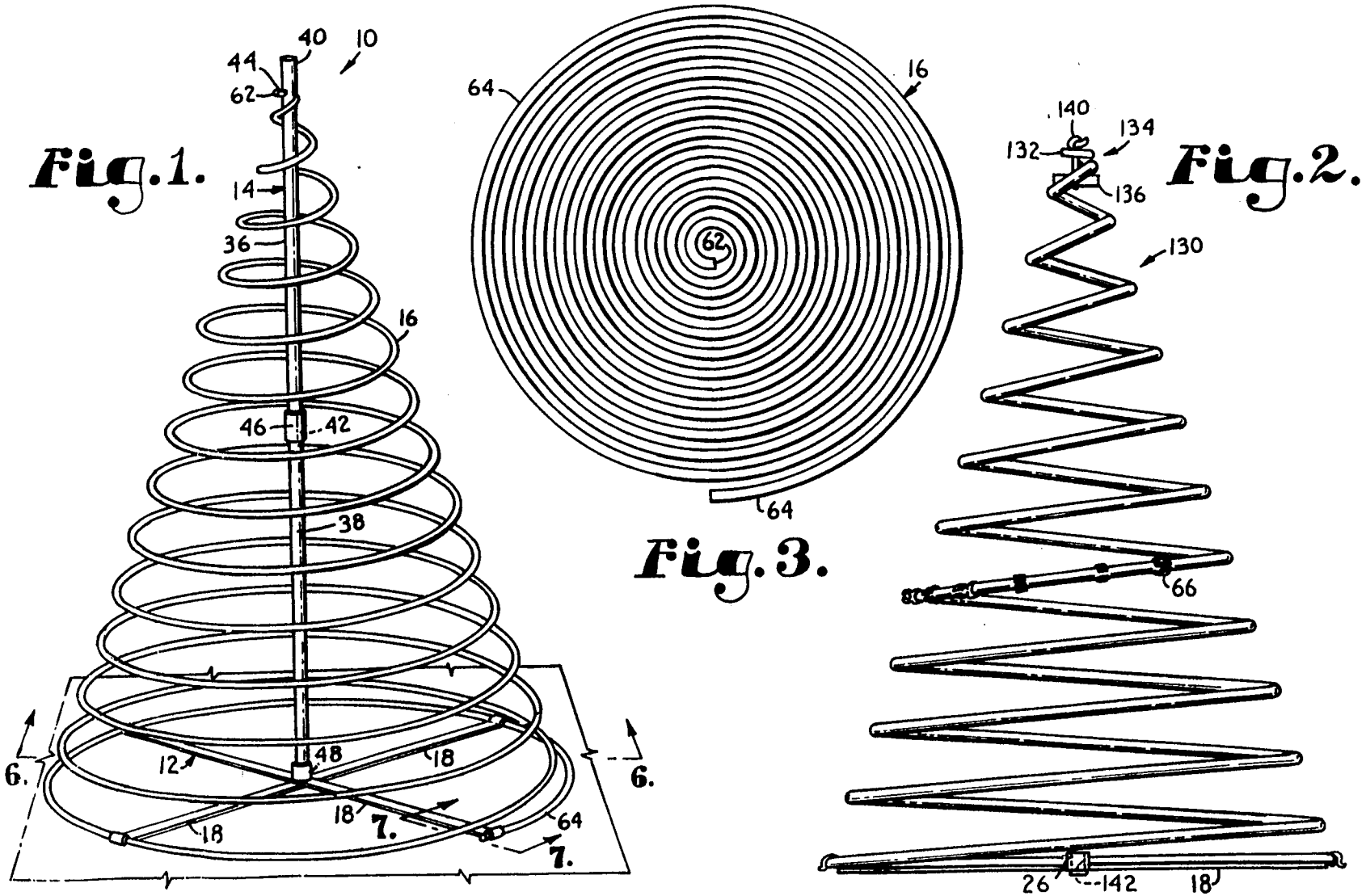
FIG. 1 is a perspective view of a collapsible cone structure of the present invention.
FIG. 2 is a side view of an alternate embodiment of the cone structure without a vertical support member.
FIG. 3 is a top plan view of the invention depicted in FIG. 1 in a collapsed mode and with the support member removed.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring now to the drawing, a collapsible cone structure 10 in accordance with the invention includes a generally X-shaped base 12, coupled with an upright support member 14 and conical body 16.

Figures 4, 5, 6, 7, 8, 9, 10:
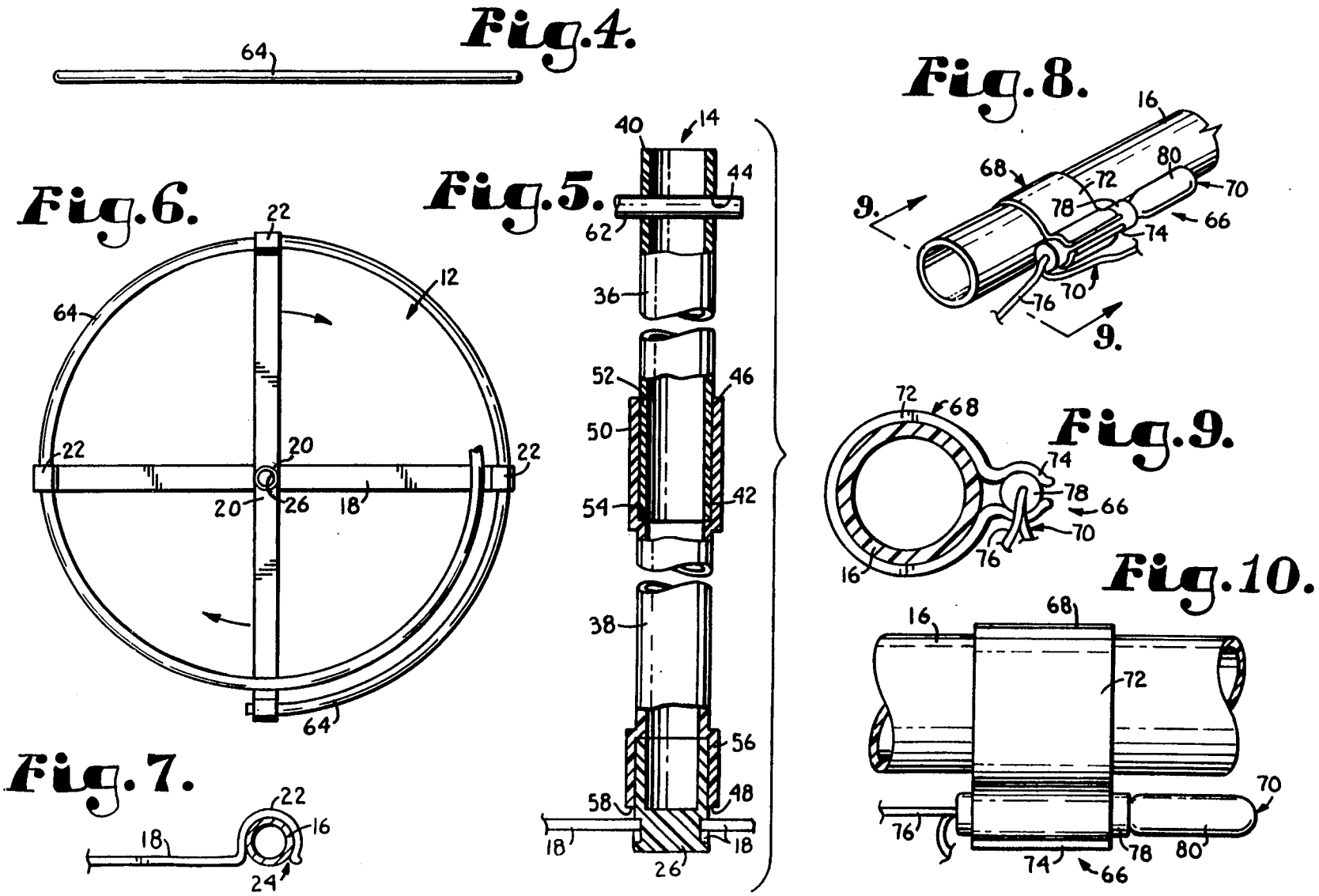
FIG. 4 is a side view of the mode depicted in FIG. 3.
FIG. 5 is a sectional view of the support member depicted in FIG. 1, with parts broken away.
FIG. 6 is a cross-sectional view taken generally along line 6—6 of FIG. 1.
FIG. 7 is an enlarged, cross-sectional view taken along line 7—7 of FIG. 1.
FIG. 8 is an enlarged fragmentary perspective view of the lighting assembly depicted in FIG. 2.
FIG. 9 is an enlarged cross-sectional view taken generally along line 9—9 of FIG. 8.
FIG. 10 is an enlarged, fragmentary side view of the lighting assembly depicted in FIGS. 8 and 9.

In more detail, base 12 includes a pair of stretchers 18, each presenting a center portion 20 and a pair of end portions 22, best shown in FIGS. 1, 6 and 7. Each end portion 22 is configured to present a downwardly oriented bight 24. Stretcher center portions 20 are overlaid and pivotally coupled by a coupling member 26 to permit rotation of the stretchers as shown in FIG. 6 from the transverse orientation depicted to a compact, congruent orientation for storage and transport. Stretchers 18 may be constructed of metal, fiberglass, synthetic resin, wood, or any other suitable material.

Figures 11, 12, 13, 14, 15, 16:
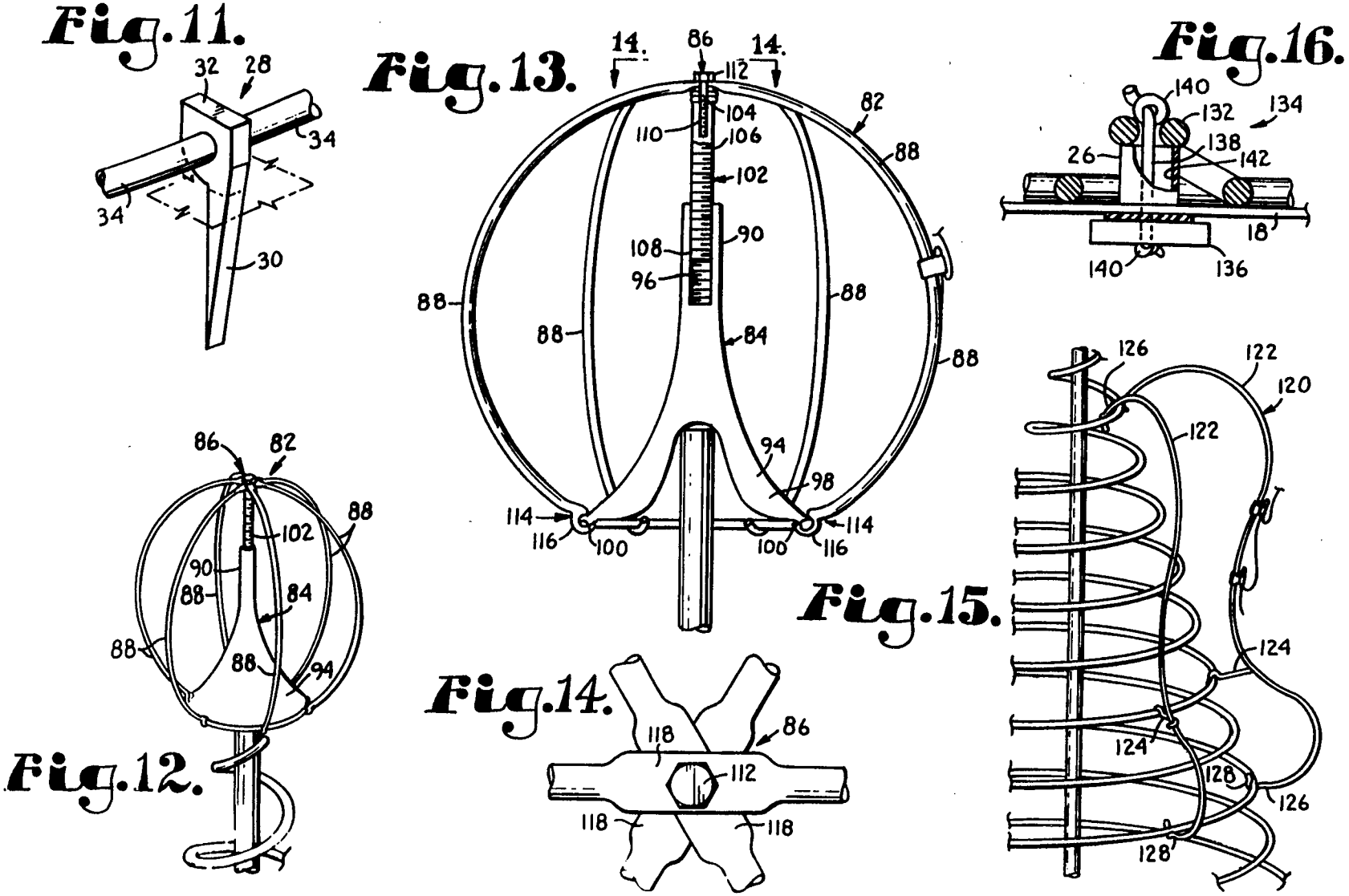
FIG. 11 is an enlarged, perspective view of a ground anchor apparatus which may be employed with the invention.
FIG. 12 is a perspective view of an exemplary character head.
FIG. 13 is an enlarged cross-sectional view of the character head depicted in FIG. 12.
FIG. 14 is a top plan view of the coupling assembly depicted in FIGS. 12 and 13.
FIG. 15 is a partial side perspective view of the embodiment depicted in FIG. 1 showing optional angel wing frame members with attached lighting assembly.
FIG. 16 is an enlarged cross-sectional view of the closure assembly depicted in FIG. 2.

An optional ground anchor 28 depicted in FIG. 11 may be employed in conjunction with base 12 to impart additional stability and to assist in levelling the structure 10. Anchor 28 includes an elongated shaft 30, generally flattened head 32, and a transverse member 34. Head 32 may be apertured to receive transverse member 34.

Support member 14 includes upper and lower portions 36, 38, upper portion 36 having an uppermost end 40 and a lowermost end 42. (FIGS. 1 and 5). An aperture 44 is located adjacent uppermost end 40. Lower portion 38 includes uppermost end 46 and lowermost end 48. Uppermost end 46 includes a radially expanded, centrally bored collet 50 having an upwardly oriented opening 52 for receiving support member 14 and a shoulder flange 54 which serves as a stop. Lowermost end 48 similarly includes a radially expanded, centrally bored collet 56 having a downwardly oriented opening 58 for receiving base coupling member 26 and a shoulder flange 60 which serves as a stop.

Support member 14 may be formed of metal such as aluminum, fiberglass, synthetic resin, wood or any other suitable material. Upper and lower portions 36, 38 may be formed of a material such as fiberglass, while upper and lower collets 50, 56 may be formed of a different material such as aluminum.

Body 16 is a continuous preferably hollow core coil of a light weight, light refractive synthetic resinous material, although any other suitable material may also be employed. The body includes a centrally oriented first end portion 62 for coupling with support aperture 44, and an elongated second end portion 64 which forms the perimeter of the coil. In preferred forms, the body is constructed of a material such as memory plastic, that is to say, a flexible synthetic resinous material which can be extended, but upon release will return to a predetermined shape. The cot 16 as depicted in FIG. 1 has a predetermined flattened shape as depicted in FIGS. 3 and 4.

Body 16 may optionally be fitted with an in-line lighting assembly 66 as best shown in FIGS. 8–10. Lighting assembly 66 includes an open figure eight-shaped clip 68 and a light string 70. Clip 68 includes a coil-encircling bight portion 72 and an open-ended, light mounting portion 74. Light string 70 includes an in-line arrangement of wires 76, sockets 78, and bulbs 80.

An optional figure head 82 for mounting atop cone structure 10 is best shown in FIGS. 12 and 13 to include a support member 84, vertically adjustable coupling assembly 86 and curvet members 88.

Support member 84 includes an uppermost first end portion 90, mid section 92, and lowermost second end portion 94. First end portion 90 includes a central bored and threaded shank 96 and second end portion 94 includes a generally funnel shaped, radially expanded rim 98 presenting a perimeter lip 100. Support member 84 may be formed of metal, fiberglass, or synthetic resinous material.

Coupling assembly 86 includes a coupling pin 102 and a continuously threaded bolt 104. Coupling pin 102 includes a centrally bored and threaded upper portion 106, and a threaded lower portion 108 for mating engagement with support member threaded shank 96. Bolt 104 includes a threaded shaft 110 for mating engagement with coupling pin upper portion 106 and a radially expanded head 112.

Curvet members 88 may be constructed of segments of coil 16 to include a pair of ends 114, each including a bight portion 116 for engaging lip 100. A generally flattened midportion 118 is apertured to permit insertion of bolt 104 therethrough for coupling curvet members 88 with coupling pin 102, which in turn is coupled with support member 84.

Figure heads 82 may also include eye, nose, mouth, and ear portions (not shown) which may be fastened to curvet members 88 by clips or other means. The figure heads may be fitted in this manner to represent various seasonal characters, such as pumpkins, witches, turkeys, Christmas characters such as Santa Claus, snowmen, angels, or stars, menorahs, flags, wreaths, or any other suitable representation. Signage may also be attached to the figure head assembly.

An optional wing assembly 120 is depicted in FIG. 15 to include a curvet member 122 and attachment hook 124. Curvet member 122 includes a pair of ends 126, each including a bight portion 128 for engaging respective windings of coil 16. Preferably hook 124 extends from the narrowest portion of curvet member 122 to a winding of coil 16.

In use, stretchers 18 are rotated to a generally X-shaped configuration, although any other configuration which is sufficiently stable may be employed. Lower support member 38 is installed by fitting lower collet over stretcher coupling member 26. Upper support member 36 is coupled with lower member 38 by fitting lowermost end 42 into upper collet 50. Upper and lower portions 36, 38 need not be of equal length, and cone structures of varying heights may be constructed by substituting longer or shorter support sections.

Body coil 16 is coupled with base 12 by fitting coil perimeter 64 into stretcher bight portions 24. Coil center end portion 62 is inserted through support member aperture 44, to secure the coil in place. The coil structure may be levelled and secured in place by inserting anchor shaft 30 into the ground adjacent coil perimeter 64 so that head 32 extends over the perimeter to maintain it in position adjacent to the ground. Anchor 28 may be rotated by a user by grasping transverse members 34. The cone structure 10 may be easily collapsed for storage or transport by reversing the order of assembly.

Figure heads 82 may be assembled by matingly engaging threaded lower coupling pin 108 with the threaded shank 96 of support member 84. Curvet members are installed by fitting the bight ends 116 over lip 100 and aligning apertured midportions 118 to permit threaded bolt shaft 110 to engage the threaded upper portion 106 of coupling pin so that bolt head 112 retains curvet midportions in place against coupling pin 102. The height of the figure head may be adjusted by rotating threaded coupling pin 102 upwardly or downwardly within support member threaded shank 96. In this manner, the overall configuration of curvet members 88 may be adjusted from generally spherical to various ovoid shapes.

Figure head 82 may be installed atop cone structure 10 by fitting support member rim 98 over support member uppermost end 40. Rim 98 is configured to retain support member 14 while permitting some freedom of movement of the rim about support member 14, so that the head may rock gently in the wind.

Wing assemblies 120 may be installed adjacent body coils 16 by engaging curvet member bights 128 and hooks 124 with respective coils.

Lighting assemblies 66 may be installed by engaging clip bight portions 72 over coil 16 as spaced locations. Light sockets 78 are then fitted into mounts 74 and bulbs 80 are installed.

Second Preferred Embodiment

A second preferred embodiment of the collapsible cone structure 130 is depicted in FIGS. 2 and 16 to include structure substantially similar to that previously described with certain modifications to the construction of coil 16 to permit construction of a cone structure without a central support member. The body coil 16 is formed of memory plastic having an open-spring resting configuration. Such a cone structure is particularly light weight, flexible and easily erected, thus making it well-suited for use as a highway marker or sign.

Apical coil end 62 is configured to present an eye 130, and a closure assembly 132 is provided to permit compression of the structure into a flat configuration similar to that depicted in FIG. 3. Closure assembly 132 includes a handle member 136 intercoupled with eye 132 by a shortened line 138 having a pair of knots 140 at either end for locking the line in place. Stretcher coupling member 26 includes an aperture 142.

In use, the second preferred embodiment of the cone structure is particularly easy to assemble. A user may compress the open-spring resting configuration for transport or storage by grasping the handle 136, rotating it to a lengthwise position for insertion through stretcher coupling member aperture 142, then again rotating the handle to a crosswise position to secure the coil 16 to the base 12.

It is to be understood that while certain forms of the present invention have been illustrated and described herein, it is not to be limited to the specific forms or arrangement of parts described and shown.

What is claimed and desired to be secured by Letters Patent is as follows:

1. A collapsible cone structure comprising:

(a) a generally X-shaped base including a pair of transversely connected slat members each presenting a pair of opposed ends;

(b) a generally upright support member having a lowermost end and an uppermost end, said lowermost end being coupled with said base;

(c) a spiral coil member having a centrally oriented first end portion and a second end portion forming a perimeter, said perimeter portion being coupled with said base slat ends, said member being shiftable between a generally cone-shaped extended configuration and a generally flattened disc-shaped resting configuration;

(d) coupling means coupling said coil first end portion to said support member end for maintaining said spiral coil member in said cone-shaped configuration; and (e) a detachable theme head comprising:

(1) a generally upright head support member having an uppermost first end and a lowermost second end, said second end being detachably coupled with said cone support member uppermost end;

(2) a plurality of curvet members, each having a pair of opposed ends and a midportion, said ends each including means coupling said ends with said head support member second end; and (3) means reversibly coupling said head support first end with said curvet member mid portion.

2. The apparatus as set forth in claim 1, wherein said means coupling said head support first end with said curvet member mid portion is vertically adjustable between an extended position and a retracted position.

3. The apparatus as set forth in claim 2 wherein said vertically adjustable coupling means further includes a threaded bolt coupling with said curvet member mid portion, said head support member first end being centrally bored and threaded for receiving sad threaded bolt.

4. The apparatus as set forth in claim 1, wherein said structure further includes a detachable wing assembly comprising:

(a) a wing member presenting a pair of ends, said ends each including means coupling said ends with said spiral coil member.

5. The apparatus as set forth in claim 4, wherein said wing member further includes a midsection having means coupling said midsection with said spiral coil member.

6. The apparatus as set forth in claim 1, further including ground anchoring means anchoring said base to the ground.

7. A collapsible cone structure comprising:

(a) a generally X-shaped base including a pair of transversely connected slat members each presenting a pair of opposed ends;

(b) a generally upright support member having a lowermost end and an uppermost end, said lowermost end being coupled with said base;

(c) a spiral coil member having a centrally oriented first end portion and a second end portion forming a perimeter, said perimeter portion being coupled with said base slat ends, said member being shiftable between a generally cone-shaped extended configuration and a generally flattened disc-shaped resting configuration;

(d) coupling means coupling said coil first end portion to said support member uppermost end for maintaining said spiral coil member in said cone-shaped configuration;

(e) a generally upright detachable theme head support member having an uppermost first end and a lowermost second end, said second end being detachably coupled with said cone support member uppermost end;

(f) a plurality of cuvet members, each having a pair of opposed ends and a midportion, said ends each including means for coupling said ends with said head support member second end; and (g) means reversibly coupling said head support first end with said curvet member mid portion.

* * * * *